US009774944B2

(12) United States Patent
Yang

(10) Patent No.: US 9,774,944 B2
(45) Date of Patent: Sep. 26, 2017

(54) CIRCUMAURAL EARPHONE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 15/173,735

(22) Filed: Jun. 6, 2016

(65) Prior Publication Data

US 2017/0026736 A1 Jan. 26, 2017

(30) Foreign Application Priority Data

Jul. 23, 2015 (TW) ..... 104123827 A

(51) Int. Cl.
*H04R 25/00* (2006.01)
*H04R 1/10* (2006.01)
*H04R 5/033* (2006.01)

(52) U.S. Cl.
CPC ..... *H04R 1/1066* (2013.01); *H04R 1/1008* (2013.01); *H04R 5/0335* (2013.01)

(58) Field of Classification Search
CPC ..... H04R 1/1008; H04R 1/1041; A61F 11/14; A42B 3/16; A42B 3/04
USPC ..... 381/370, 371, 379
See application file for complete search history.

(56) References Cited

U.S. PATENT DOCUMENTS 4,104,743 A * 8/1978 Bottger ..... A42B 3/166 2/423
4,944,361 A * 7/1990 Lindgren ..... A61F 11/14 181/129
7,283,641 B2 * 10/2007 Rolla ..... A42B 3/166 381/370
7,383,641 B2 * 6/2008 Fernandes ..... D21F 1/0027 162/361
2010/0189303 A1 7/2010 Danielson et al.

FOREIGN PATENT DOCUMENTS

| | | |
|---|---|---|
| CN | 101330766 | 7/2011 |
| TW | M445314 | 1/2013 |
| TW | I407941 | 9/2013 |
| TW | M475777 | 4/2014 |

OTHER PUBLICATIONS

"Office Action of Taiwan Counterpart Application", dated Nov. 22, 2016, p. 1-p. 4.
"Office Action of Taiwan Counterpart Application", dated Mar. 28, 2017, p. 1-p. 5.

* cited by examiner

*Primary Examiner* — Sunita Joshi
(74) *Attorney, Agent, or Firm* — Jianq Chyun IP Office

(57) ABSTRACT

A circumaural earphone adapted to be worn on a head of a user is provided. The circumaural earphone includes a main frame, two adjusting modules and two earphone cups. The two adjusting modules are connected to two opposite ends of the main frame respectively. The two earphone cups are connected to the two adjusting modules respectively. Each of the adjusting modules is rotated to drive the corresponding earphone cup to move close to or away from the head of the user so as to adjust a clamping force applied to the head of the user by the two earphone cups.

7 Claims, 4 Drawing Sheets

CIRCUMAURAL EARPHONE

CROSS REFERENCE TO RELATED APPLICATION

This application claims the priority benefits of Taiwan application serial no. 104123827, filed on Jul. 23, 2015 . The entirety of the above-mentioned patent application is hereby incorporated by reference herein and made a part of specification.

BACKGROUND OF THE INVENTION

Field of the Invention

The invention relates to an earphone, and specifically relates to a circumaural earphone.

Description of Related Art

Along with the continuous development of science and technology and in order to meet the requirements of the user, becoming thinner is the development trend of the electronic products, so that it is more convenient for the user to carry the electronic products thus the user can watch or listen to a variety of audio and video via the electronic products, such as MP3 player, smartphone, tablet PC, or notebook computer, etc., anytime and anywhere. In order to allow a user/listener to listen to the audio information provided by the electronic products without disturbing the other people around, an earphone has obviously become a necessary accessory to the electronic product. To be more specific, the earphone may provide a better audio quality to the user, for example, the user is not easy to be affected or interfered by the outside environment when moving, exercising, or being in a noisy environment.

Take a circumaural earphone as an example, since the circumaural earphone can cover the ears of the user completely, so as to further prevent the user from being affected of interfered by the outside environment when the user listens to the audio information provided by the electronic products. Generally, the circumaural earphone is formed by a main frame and two earphone cups connected to the main frame. Since most of the main frame is flexible, when the user wears the circumaural earphone on the head, a clamping force may be generated, so the earphone cups are securely attached in the vicinity of the ears of the user. However, the clamping force is currently not adjusted according to the personal preference, the shape of the head, or the feeling of the user, so an uncomfortable feeling is easily generated when the user wears the circumaural earphone. Recently, the earphone cups of some circumaural earphone may rotate or move with respect to the main frame thereby slightly adjusting a clamping angle between the earphone cups and a central axis of the main frame, but the clamping force generated at the left and rights ears when the circumaural earphone is worn on the head of the user is not significantly changed.

SUMMARY OF THE INVENTION

The invention provides a circumaural earphone having an adjustable clamping force when being worn on a head of a user, especially, the clamping force applied to the left and right ears of the head may be adjustable.

The invention proposes a circumaural earphone adapted to be worn on a head of a user. The circumaural earphone includes a main frame, two adjusting modules and two earphone cups. The two adjusting modules are connected to two opposite ends of the main frame respectively. The two earphone cups are connected to the two adjusting modules respectively. Each of the adjusting modules is rotated to drive the corresponding earphone cup to move close to or away from the head of the user so as to adjust a clamping force applied to the head of the user by the two earphone cups.

In one embodiment of the invention, each of the adjusting modules includes a rotating member, a moving member, and a positioning member. Each rotating member is adapted to rotate along a corresponding axis. Each moving member is coupled on the corresponding rotating member. Each positioning member is sleeved on the corresponding rotating member and mutually connected with the corresponding earphone cup. Each positioning member has a positioning portion. When each rotating member rotates along the corresponding axis, each rotating member drives the corresponding moving member to move, and each positioning member rotates with the corresponding rotating member, so that each moving member leans against different positioning points of the positioning portion of the corresponding positioning member.

In one embodiment of the invention, each rotating member includes a turning knob and a guide rod. Each guide rod is connected to the corresponding turning knob and has a first screw thread. Each moving member is coupled to the corresponding guide rod and has a second screw thread matching with the first screw thread of the corresponding guide rod.

In one embodiment of the invention, each adjusting module further includes a housing. The housing is connected to the main frame. Each turning knob may be rotatably disposed on the corresponding housing. Each guide rod, each moving member, and each positioning member are located inside the corresponding housing.

In one embodiment of the invention, each of the adjusting modules further includes a positioning ring. Each positioning ring connected to the corresponding turning knob. Each positioning ring is located inside the corresponding housing and has a plurality of positioning recesses. Each housing has a positioning protrusion coupled to the corresponding positioning ring. When each rotating member rotates along the corresponding axis, each positioning protrusion is adapted to interlock with one of the positioning recesses of the corresponding positioning ring.

In one embodiment of the invention, each of the adjusting modules includes a rotating member and a positioning member. The rotating member is adapted to rotate along an axis and to move along a direction parallel to the axis. The positioning member is connected to the rotating member. Each positioning member has a positioning portion, and each positioning portion leans against a latch of the corresponding earphone cup. When each rotating member rotates along the corresponding axis, each positioning member rotates with the corresponding rotating member, so that each latch leans against different positioning points of the positioning portion of the corresponding positioning member.

In one embodiment of the invention, each positioning member and the corresponding rotating member are integrally formed, and each positioning portion is a guide oblique surface of the corresponding positioning member.

In one embodiment of the invention, each adjusting module further includes a housing. The housing is connected to the main frame. Each rotating member is rotatably disposed on the corresponding housing, and each positioning member is located inside the corresponding housing.

Based on the above, since the circumaural earphone of the invention is configured to have the adjusting modules, the user can adjust the clamping force applied to the head by the circumaural earphone, especially the clamping force applied to the left and right ears of the head, according to the personal preference, the shape of the head, or the feeling of the user via the adjusting modules after the circumaural earphone is worn on the head. Therefore, not only is the circumaural earphone firmly worn on the head of the user, but also the uncomfortable feeling of the user caused by an excessive clamping force is prevented.

In order to make the aforementioned and other features and advantages of the invention more comprehensible, embodiments accompanying figures are described in detail below.

DESCRIPTION OF THE EMBODIMENTS

Figure 1:
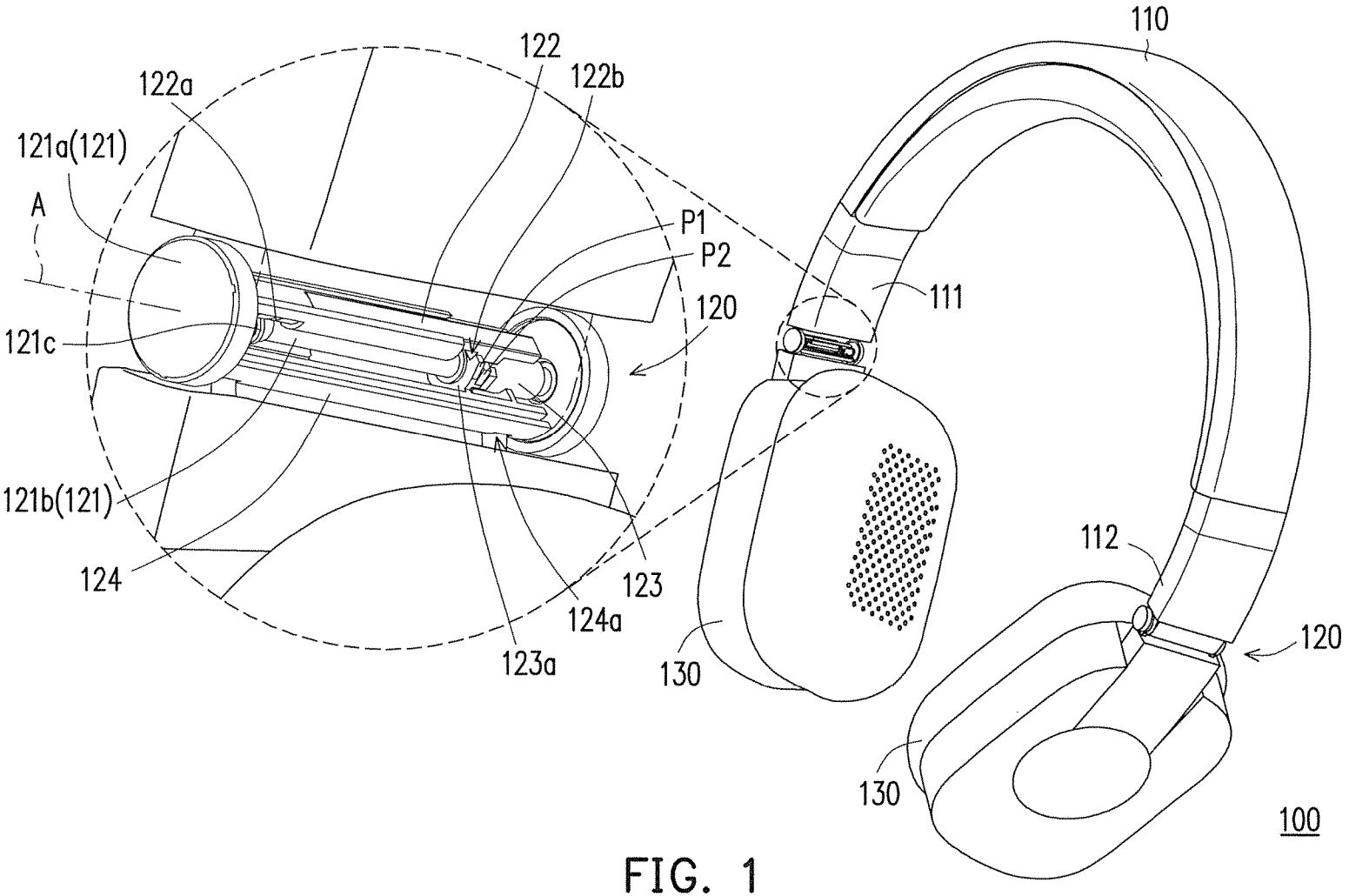
FIG. 1 is a schematic view of a circumaural earphone in one embodiment of the invention.
Figure 2:
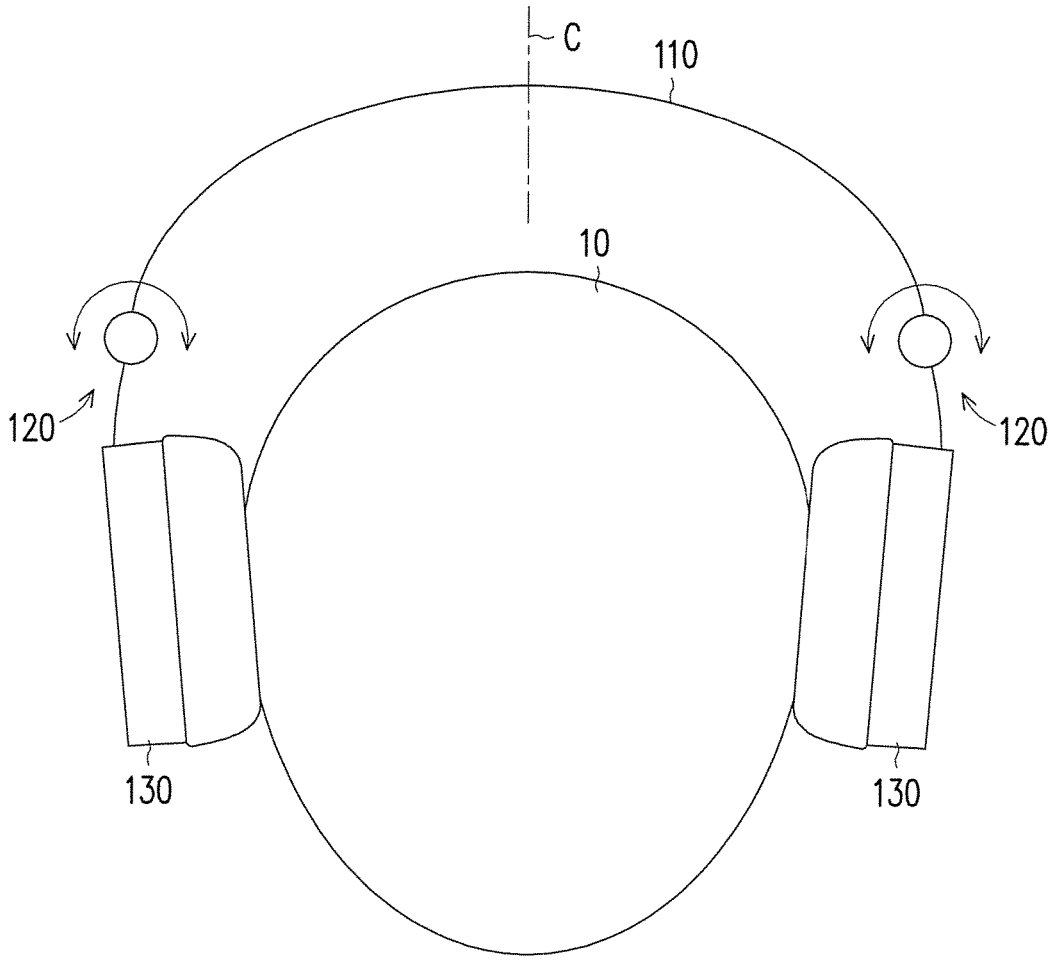
FIG. 2 is a simple schematic view of the circumaural earphone in FIG. 2 being worn on the head of the user.
Figure 3:
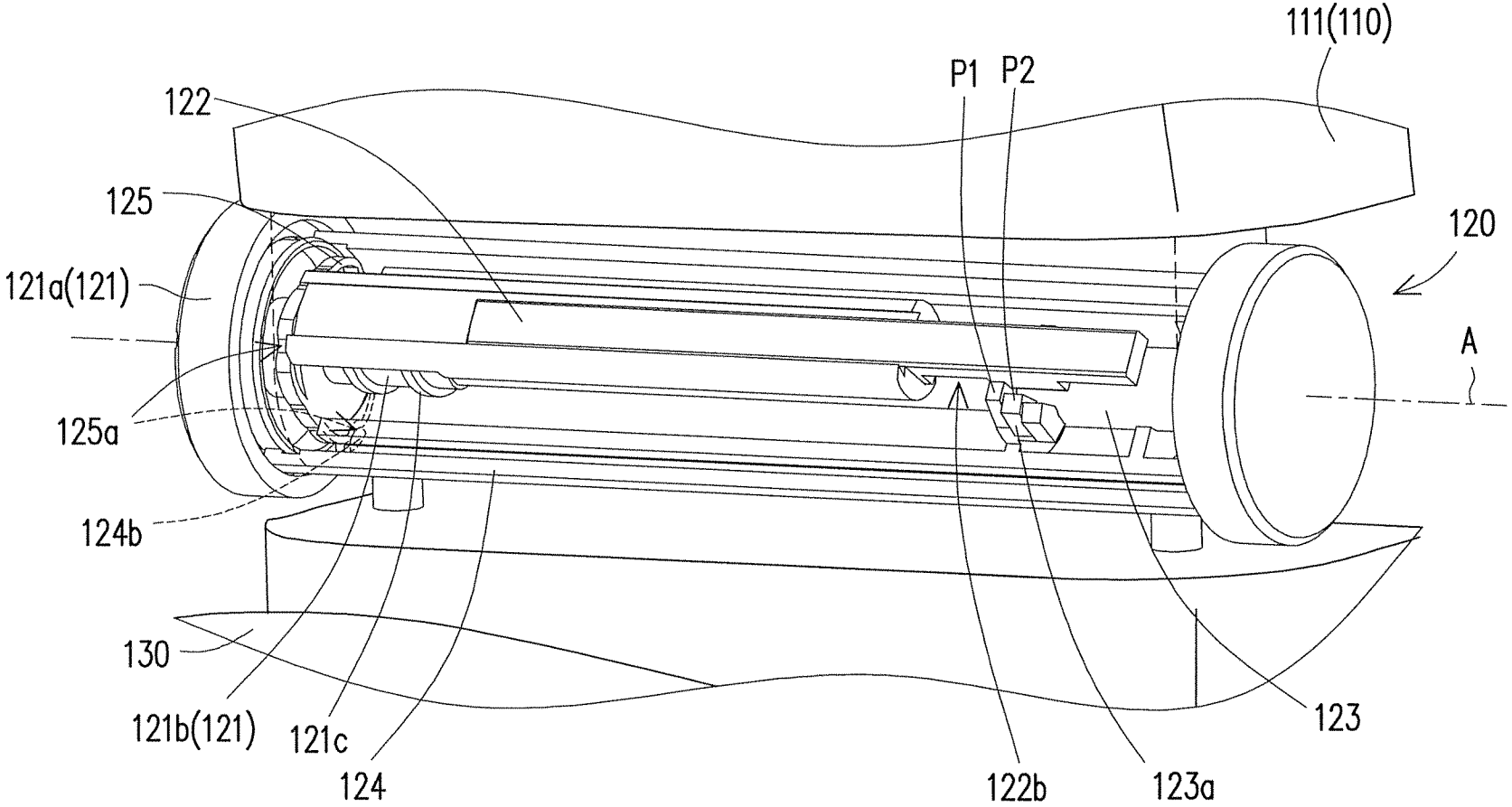
FIG. 3 is a partial enlarged view of an adjusting module in FIG. 1 from another viewing angle.

FIG. 1 is a schematic view of a circumaural earphone in one embodiment of the invention. FIG. 2 is a simple schematic view of the circumaural earphone in FIG. 2 being worn on the head of the user. FIG. 3 is a partial enlarged view of an adjusting module in FIG. 1 from another viewing angle. Referring to FIG. 1 to FIG. 3, in the present embodiment, a circumaural earphone 100 includes a main frame 110, two adjusting modules 120, and two earphone cups 130. The circumaural earphone 100 is adapted to be worn on a head 10 of an user, and the two earphone cups 130 are adapted to respectively cover the left and right ears (not shown) of the head 10.

The main frame 110 presents a curved arc shape and has two opposite ends 111 and 112. The two ends 111 and 112 opposite each other are not in contact, and the two adjusting modules 120 are respectively connected to the two ends 111 and 112. On the other hand, the two earphone cups 130 are respectively connected to the two adjusting modules 120 and are opposite each other. As shown in FIG. 2, when the user wears the circumaural earphone 100 on the head 10 and makes the two earphone cups 130 respectively cover the left and right ears (not shown) of the head 10, the user can rotate each of the adjusting modules 120 to drive the corresponding earphone cup 130 to move close to or away from the head 10 of the user so as to adjust a clamping force applied to the head 10 by the two earphone cups 130, especially the clamping force applied to the left and right ears of the head. Take the adjusting module 120 enlarged in FIG. 1 as an example, and the structure and operation mechanism of the adjusting module 120 are described as followings.

Referring to FIG. 1, the adjusting module 120 may include a rotating member 121, a moving member 122, and a positioning member 123, the user can apply a force to the adjusting module 120 to rotate the adjusting module 120 along an axis A. The moving member 122 is coupled on the rotating member 121, wherein the positioning member 123 is sleeved on the rotating member 120 and mutually connected with the earphone cup 130. The positioning member 123 has a positioning portion 123*a*. When the rotating member 120 rotates along the axis A, the rotating member 120 drives the moving member 122 to move along a direction parallel to the axis A, and the positioning member 123 rotates with the rotating member 121, so that the moving member 122 leans against different positioning points of the positioning portion 123*a* of the positioning member 123. When the moving member 122 leans against different positioning points of the positioning portion 123*a* of the positioning member 123, simultaneously, it can determine a clamping angle between the earphone cup 130 and a central axis C of the main frame 110, the minimum distance between the two earphone cups 130, and the clamping force applied to the head 10 by the two earphone cups 130, especially the clamping force applied to the left and right ears (not shown) of the head 10 as shown in FIG. 2.

In other words, the user can adjust the clamping force applied to the head 10 by the circumaural earphone, especially the clamping force applied to the left and right ears (not shown) of the head 10, according to the personal preference, the shape of the head, or the feeling of the user via the adjusting modules after the circumaural earphone is worn on the head. Therefore, not only is the circumaural earphone 100 firmly worn on the head 10 of the user, but also the uncomfortable feeling of the user caused by an excessive clamping force is prevented.

Referring to FIG. 1 and FIG. 3, the rotating member 121 may include a turning knob 121*a* and a guide rod 121*b* mutually connected with the turning knob 121*a*, wherein the turning knob 121*a* and the guide rod 121*b* are integrally formed, for example. In other embodiments, the guide rod 121*b* may also be inserted into the turning knob 121*a* . In the present embodiment, the turning knob 121*a* is mainly disposed for a purpose that the user can conveniently apply a force to drive the guide rod 121*b* to rotate along the axis A. The guide rod 121*b* has a first screw thread 121*c*, and the moving member 122 coupled to the guide rod 121*b* has a second screw thread 122*a* matching with the first screw thread 121*c* . Therefore, when the guide rod 121*b* rotates along the axis A, the second screw thread 122*a* of the moving member 122 is guided by the first screw thread 121*c* of the guide rod 121*b* to make the moving member 122 move close to or away from the turning knob 121*a*.

For example, when the moving member 122 moves away from the turning knob 121*a* and reaches a travelling distance, a first positioning point P1 of the positioning portion 123*a* that originally leans against the moving member 122 in FIG. 1 is moved into a given way groove 122*b* of the moving member 122. On the other hand, the positioning member 123 rotating with the guide rod 121*b* leans against the moving member 122 by a second positioning point P2 of the positioning portion 123*a* . At this time, the positioning members 123 can drive the earphone cups 130 close to the head 10 of the user and then adjust the clamping force applied to the head 10 by the earphone cups 130, especially the clamping force applied to the left and right ears (not shown) of the head 10. It should be noted here, there are only three positioning points of the positioning portion 123*a* depicted in FIG. 1, but the invention is not limited thereto. In other embodiments, the number of the positioning points of the positioning portion 123*a* is varied according to the actual design requirement, so as to provide the clamping force with different values for the user to select.

In the present embodiment, the adjusting module 120 further includes a housing 124 and a positioning ring 125, wherein the main frame 110 and the housing 124 are connected to each other. The turning knob 121*a* is rotatably disposed on the housing 124, and the guide rod 121*b*, the moving member 122, and the positioning member 123 are located inside the housing 124. A slot 124*a* is disposed at the housing 124. A part of the positioning member 123 passes through the slot 124*a*, so as to connect to the earphone cup 130. On the other hand, the positioning ring 125 is connected to the turning knob 121*a*, for example, the positioning ring 125 and the turning knob 121*a* are integrally formed. The positioning ring 125 is located inside the housing 124 and has a plurality of positioning recesses 125*a* . The housing 124 has a positioning protrusion 124*b* coupled to the positioning ring 125. When the rotating member 121 rotates along the axis A, the positioning protrusion 124*b* is adapted to interlock with one of the positioning recesses 125*a*.

When the positioning protrusion 124*b* is interlocked with one of the positioning recesses 125*a*, one of the positioning points of the positioning portion 123*a* of the positioning member 123 also leans against the moving member 122, so as to determine a clamping angle between the earphone cup 130 and a central axis C of the main frame 110, the minimum distance between the two earphone cups 130, and the clamping force applied to the head 10 by the two earphone cups 130, especially the clamping force applied to the left and right ears (not shown) of the head 10 as shown in FIG. 2. It is worth mentioning that the number of the positioning protrusions 124*b* is, for example, corresponding to the number of the positioning points of the positioning portion 123*a*.

Another embodiment is described hereinafter. It should be noted, the embodiments below utilize component labels and partial content from the aforementioned embodiment, wherein identical or similar elements are labeled with identical labels, and therefore description of similar technical content will be omitted. Regarding the description of the omitted parts, reference may be made to the previous embodiment, and will not be repeated in the below embodiment.

Figure 4:
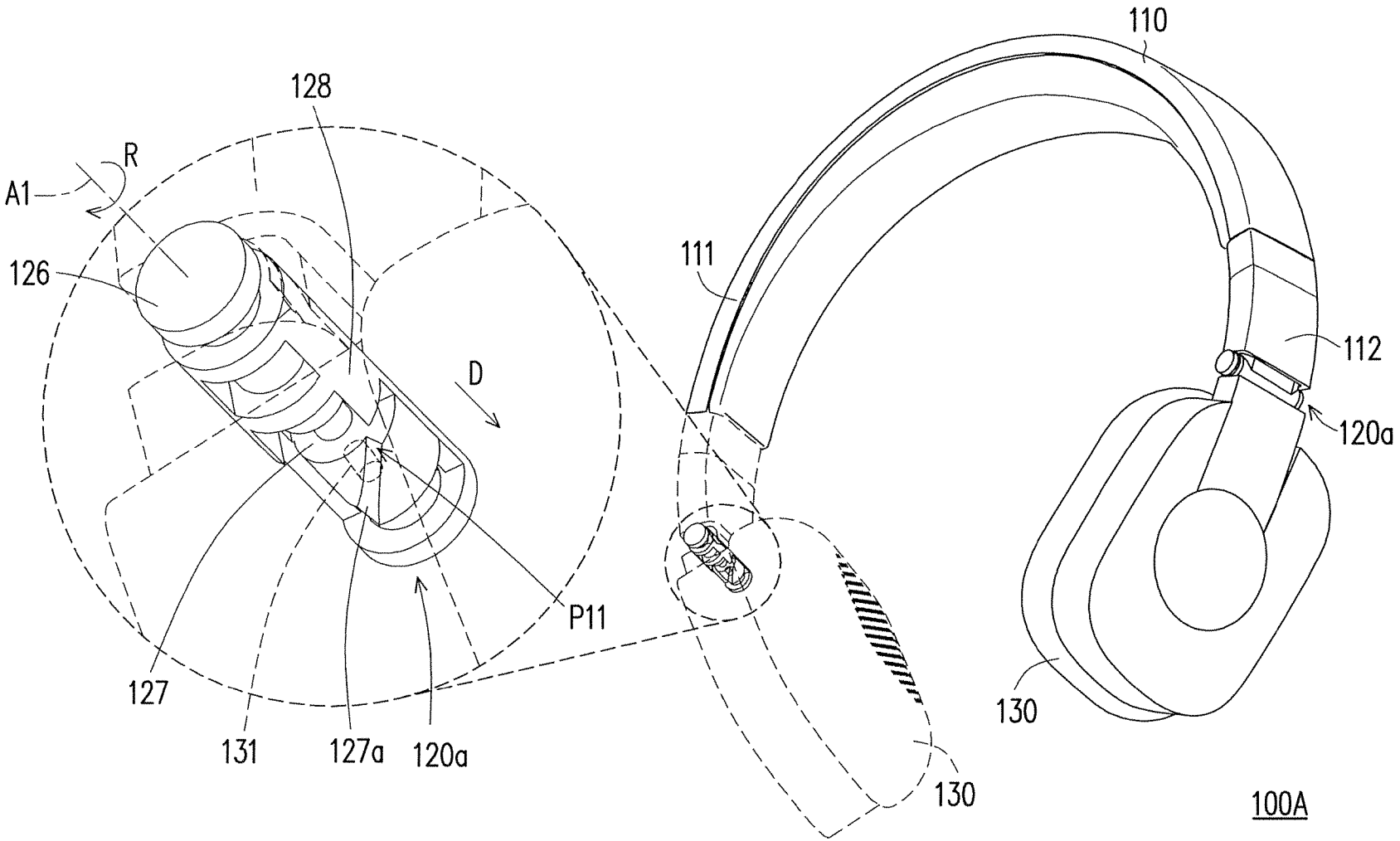
FIG. 4 is a schematic view of a circumaural earphone in another embodiment of the invention.

FIG. 4 is a schematic view of a circumaural earphone in another embodiment of the invention. Referring to FIG. 4, the operation mechanism of the circumaural earphone 100A in FIG. 4 is similar to the operation mechanism of the circumaural earphone 100 of the previous embodiment that is used to adjust the clamping force applied to the head 10 (shown in FIG. 2) by the two earphone cups 130, but the adjusting module 120*a* of the circumaural earphone 100A is slightly different from the adjusting module 120 of the circumaural earphone 100. Take the adjusting module 120*a* enlarged in FIG. 4 as an example, and the structure and operation mechanism of the adjusting module 120*a* are described as followings.

In the present embodiment, the adjusting module 120*a* includes a rotating member 126 and a positioning member 127 mutually connected to the rotating member 126, wherein the positioning member 127 and the rotating member 126 are integrally formed, for example. In other embodiments, the positioning member 127 can also be sleeved on the rotating member 126. More specifically, the rotating member 126 is adapted to rotate along an axis A and to move along a direction parallel to the axis A. The positioning member 127 has a positioning portion 127*a*, and the positioning portion 127*a* and a latch 131 of the earphone cup 130 lean against each other. When the rotating member 126 rotates along the axis A, the positioning member 127 rotates with the rotating member 126, so that the latch 131 leans against different positioning points of the positioning portion 127*a* of the positioning member 127. When the latch 131 leans against different positioning points of the positioning portion 127*a* of the positioning member 127, simultaneously, it can determine a clamping angle between the earphone cup 130 and the central axis C (shown in FIG. 2) of the main frame 110, the minimum distance between the two earphone cups 130, and the clamping force applied to the head 10 (shown in FIG. 2) by the two earphone cups 130, especially the clamping force applied to the left and right ears (not shown) of the head 10 (shown in FIG. 2).

As shown in FIG. 4, the adjusting module 120*a* further includes a housing 128 mutually connected to the main frame 110. The rotating member 126 can be rotatably disposed on the housing 128, and the positioning member 127 is located inside the housing 128. In the present embodiment, the positioning portion 127*a* of the positioning member 127 is a guide oblique surface, for example. For example, when the rotating member 126 rotates with respect to the housing 128 along a rotating direction R and moves with respect to the housing 128 along a direction D, the positioning point of the positioning portion 127*a* of the positioning member 127 that leans against the latch 131 of the earphone cup 130 is also changed accordingly, for example, gradually moving away from the first positioning point P11 shown in FIG. 4.

At this time, the positioning portion 127*a* pushes against the latch 131, so as to drive the earphone cups 130 toward the head 10 (shown in FIG. 2) of the user and then to adjust the clamping force applied to the head 10 (shown in FIG. 2) by the two earphone cups 130, especially the clamping force applied to the left and right ears (not shown) of the head 10 (shown in FIG. 2).

It is worth mentioning that the adjusting modules are not limited to disposing at two opposite ends of the main frame as in the above-mentioned embodiments of the invention. In other embodiments, the adjusting modules may also be disposed at the center of the main frame (such as being located on the central axis of the main frame), and the number of the adjusting modules may be one or two. As a result, via the adjusting modules, the user can also adjust the clamping force applied to the head by the two earphone cups, especially the clamping force applied to the left and right ears of the head.

In summary, since the circumaural earphone of the invention is configured to have the adjusting modules, the user can adjust the clamping force applied to the head by the circumaural earphone, especially the clamping force applied to the left and right ears of the head, via the adjusting modules after the circumaural earphone is worn on the head. Therefore, not only is the circumaural earphone firmly worn on the head of the user, but also the uncomfortable feeling of the user caused by an excessive clamping force is prevented.

Although the invention has been disclosed with reference to the aforesaid embodiments, they are not intended to limit the invention. It will be apparent to one of ordinary skill in the art that modifications and variations to the described embodiments may be made without departing from the spirit and the scope of the invention. Accordingly, the scope of the invention will be defined by the attached claims and not by the above detailed descriptions.

What is claimed is:

1. A circumaural earphone adapted to be worn on a head of a user, the circumaural earphone comprising:

a main frame;

two adjusting modules, connected to two opposite ends of the main frame respectively; and two earphone cups, connected to the two adjusting modules respectively, wherein each of the adjusting modules is rotated to drive the corresponding earphone cup to move close to or away from the head of the user so as to adjust a clamping force applied to the head of the user by the two earphone cups, wherein each of the adjusting modules comprises:

a rotating member, adapted to rotate along an axis;

a moving member, coupled on the rotating member; and a positioning member, sleeved on the rotating member, wherein each positioning member and the corresponding earphone cup are mutually connected, each positioning member has a positioning portion, when each rotating member rotates along the corresponding axis, each rotating member drives the corresponding moving member to move, and each positioning member rotates with the corresponding rotating member, so that each moving member leans against different positioning points of the positioning portion of the corresponding positioning member.

2. The circumaural earphone as recited in claim 1, wherein each rotating member comprises:

a turning knob; and a guide rod, connected to the turning knob, and having a first screw thread, wherein each moving member is coupled to the corresponding guide rod and has a second screw thread matching with the first screw thread of the corresponding guide rod.

3. The circumaural earphone as recited in claim 2, wherein each of the adjusting modules further comprises:

a housing, connected to the main frame, wherein each turning knob is rotatably disposed on the corresponding housing, and each guide rod, each moving ember, and each positioning member are located inside the corresponding housing.

4. The circumaural earphone as recited in claim 3, wherein each of the adjusting modules further comprises:

a positioning ring, connected to the corresponding turning knob, wherein each positioning ring is located inside the corresponding housing and has a plurality of positioning recesses, each housing has a positioning protrusion coupled to the corresponding positioning ring, when each rotating member rotates along the corresponding axis, each positioning protrusion is adapted to interlock with one of the positioning recesses of the corresponding positioning ring.

5. A circumaural earphone adapted to be worn on a head of a user, the circumaural earphone comprising:

a main frame;

two adjusting modules, connected to two opposite ends of the main frame respectively; and two earphone cups, connected to the two adjusting modules respectively, wherein each of the adjusting modules is rotated to drive the corresponding earphone cup to move close to or away from the head of the user so as to adjust a clamping force applied to the head of the user by the two earphone cups, wherein each of the adjusting modules comprises:

a rotating member, adapted to rotate along an axis and to move along a direction parallel to the axis; and a positioning member, connected to the rotating member, wherein each positioning member has a positioning portion, and each positioning portion leans against a latch of the corresponding earphone cup, when each rotating member rotates along the corresponding axis, each positioning member rotates with the corresponding rotating member, so that each latch leans against different positioning points of the positioning portion of the corresponding positioning member.

6. The circumaural earphone as recited in claim 5, wherein each positioning member and the corresponding rotating member are integrally formed, and each positioning portion is a guide oblique surface of the corresponding positioning member.

7. The circumaural earphone as recited in claim 5, wherein each of the adjusting modules further comprises:

a housing, connected to the main frame, wherein each rotating member is rotatably disposed on the corresponding housing, and each positioning member is located inside the corresponding housing.

* * * * *